US008512085B1

(12) United States Patent
Kobilic

(10) Patent No.: US 8,512,085 B1
(45) Date of Patent: Aug. 20, 2013

(54) TIE BAR APPARATUSES FOR MARINE VESSELS

(75) Inventor: David A. Kobilic, Oakfield, WI (US)

(73) Assignee: Brunswick Corporation, Lake Forest, IL (US)

( * ) Notice: Subject to any disclaimer, the term of this patent is extended or adjusted under 35 U.S.C. 154(b) by 116 days.

(21) Appl. No.: 13/224,058

(22) Filed: Sep. 1, 2011

(51) Int. Cl.
*B63H 20/12* (2006.01)

(52) U.S. Cl.
USPC ..... 440/63; 114/144 R

(58) Field of Classification Search
USPC ..... 440/63; 114/144 R
See application file for complete search history.

(56) References Cited

U.S. PATENT DOCUMENTS

| | | | | |
|---|---|---|---|---|
| 6,234,853 | B1 | 5/2001 | Lanyi et al. | |
| 6,406,340 | B1 | 6/2002 | Fetchko et al. | |
| 6,699,082 | B2 * | 3/2004 | Zeiger | 440/63 |
| 6,913,497 | B1 | 7/2005 | Ahlswede et al. | |
| 7,056,169 | B1 | 6/2006 | Lokken et al. | |
| 7,207,854 | B1 | 4/2007 | Anderson, Jr. et al. | |
| 7,267,588 | B1 * | 9/2007 | Griffiths et al. | 440/63 |
| 7,527,538 | B2 | 5/2009 | Mizutani | |
| 8,060,265 | B2 * | 11/2011 | Hallenstvedt et al. | 701/21 |

* cited by examiner

*Primary Examiner* — Edwin Swinehart
(74) *Attorney, Agent, or Firm* — Andrus, Sceales, Starke & Sawall, LLP

(57) ABSTRACT

A tie bar apparatus is for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

17 Claims, 7 Drawing Sheets

TIE BAR APPARATUSES FOR MARINE VESSELS

FIELD

The present disclosure relates to marine propulsion systems having two or more marine drives, and more particularly to tie-bar apparatuses for such systems.

BACKGROUND

U.S. Pat. No. 6,913,497, which is hereby incorporated herein by reference in entirety, discloses a connection system for connecting two or more marine propulsion devices together. The connection system provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

U.S. Pat. No. 7,207,854, which is hereby incorporated herein by reference in entirety, discloses a tie bar arrangement. The tie bar arrangement uses a rod end cartridge assembly that provides relative rotatability between an associated rod end and a coupler tube. The provision of a connecting link and steering arm adapter associated with the rod end cartridge assembly also provides relative rotation about first and second axes which allow sufficient flexibility to avoid placing the tie bar arrangement under excessive stress when one marine propulsion device is tilted relative to another marine propulsion device.

U.S. Pat. No. 7,056,169, which is hereby incorporated herein by reference in entirety, discloses a connection device for a marine propulsion system in which a selective locking mechanism automatically connects or disconnects two components of the marine propulsion system together in response to rotation of a tube and a rod. This relative rotation of the tube and rod is caused automatically when one of the components of the marine propulsion system is rotated relative to the other component.

U.S. patent application Ser. No. 13/052,263, which is hereby incorporated herein by reference in entirety, discloses a marine propulsion system including multiple marine drives, a variable tie-bar including a hydraulic cylinder and an extensible and retractable plunger permitting extension and retraction of the plunger along a travel stroke to allow variable separation of the marine drives about respective steering axes, and a mechanical lock having a locking condition mechanically setting a fixed separation of the marine drives about their respective steering axes.

SUMMARY

During research and development of marine propulsion systems having two or more marine drives, the present inventor has realized that because known tie bar apparatuses have pivot axes that are located in-line with the steering axes of the marine drives, the marine drives remain parallel with each other during rotation about the respective steering axes, i.e. the marine drives are aligned with each other when oriented in a straight forward position and when oriented in a turning position. As a result, the direction of thrust of the respective drives is not always aligned with the actual path of travel of the drives. This is inefficient and does not effectively utilize available thrust during turning maneuvers. The inventor also realized that such prior art marine propulsion systems having two or more marine drives require minimum spacing between the drives to allow for turning of each drive about its steering axis.

Upon recognition of these problems with prior art systems and prior art tie bar apparatuses, the present inventor conceived of the tie bar apparatuses for marine vessels that are disclosed herein. In some examples, a tie bar apparatus for a marine vessel having at least first and second marine drives comprises a linkage that is geometrically configured to connect the first and second marine drives together so that during turning movement of the marine vessel, the first and second marine drives steer about respective first and second vertical steering axes at different angles, respectively. The tie bar apparatus can thus be configured to cause the marine drives to remain aligned with their respective paths of curvature. In some examples, the tie bar apparatus connects the first and second marine drives together and can comprise a first portion that is pivotable about the first steering axis, a second portion that is pivotable about the second steering axis, and a third portion that extends between and is pivotable with respect to both the first and second portions.

DETAILED DESCRIPTION OF DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
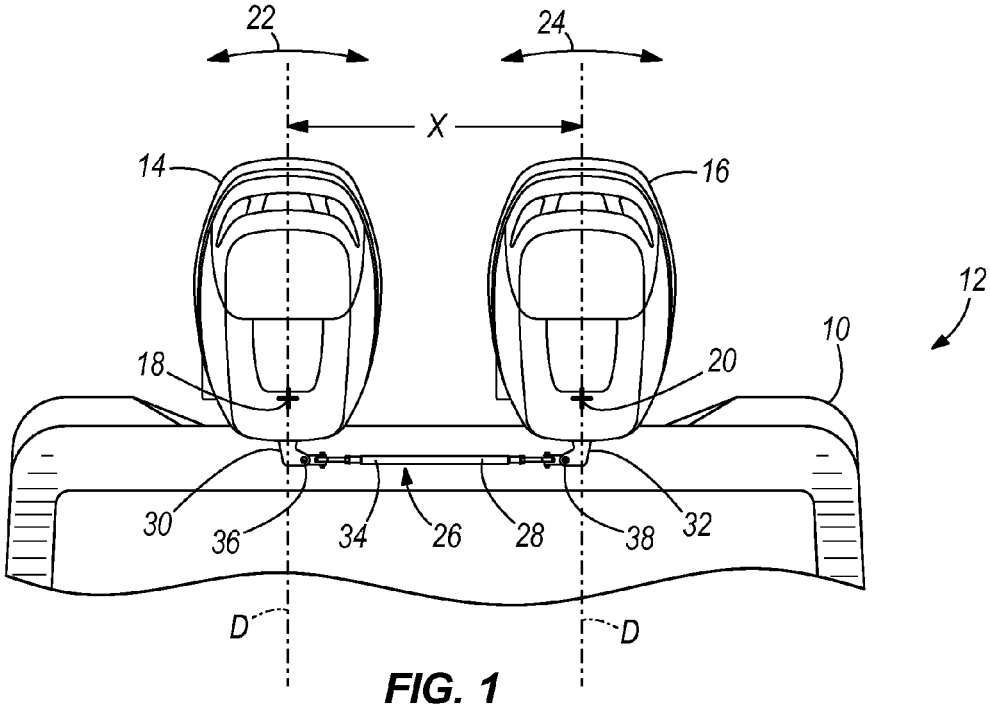
FIG. 1 is a top view of a marine vessel having first and second marine drives oriented in a forward position.

FIG. 1 depicts the stern 10 of a marine vessel 12. First and second marine drives 14, 16 are located at the stern 10 for propelling the vessel 12. The marine drives 14, 16 are attached to the vessel 12 in a conventional manner such that each drive 14, 16 is rotatable about a respective vertical steering axis 18, 20 to achieve a turning movement of the vessel 12. FIG. 1 depicts the first and second marine drives 14, 16 in a longitudinally aligned orientation (along a direction D) with respect to the vessel 12 for achieving forward and/or rearward longitudinal translation of the vessel 12. As will be understood by those having ordinary skill in the art, each drive 14, 16 is rotatable about the respective steering axis 18, 20 in both clockwise and counterclockwise directions when viewed from the top, as shown by arrows 22, 24 in FIG. 1, to achieve both port-wise and starboard-wise turning movements of the vessel 12.

Figure 2:
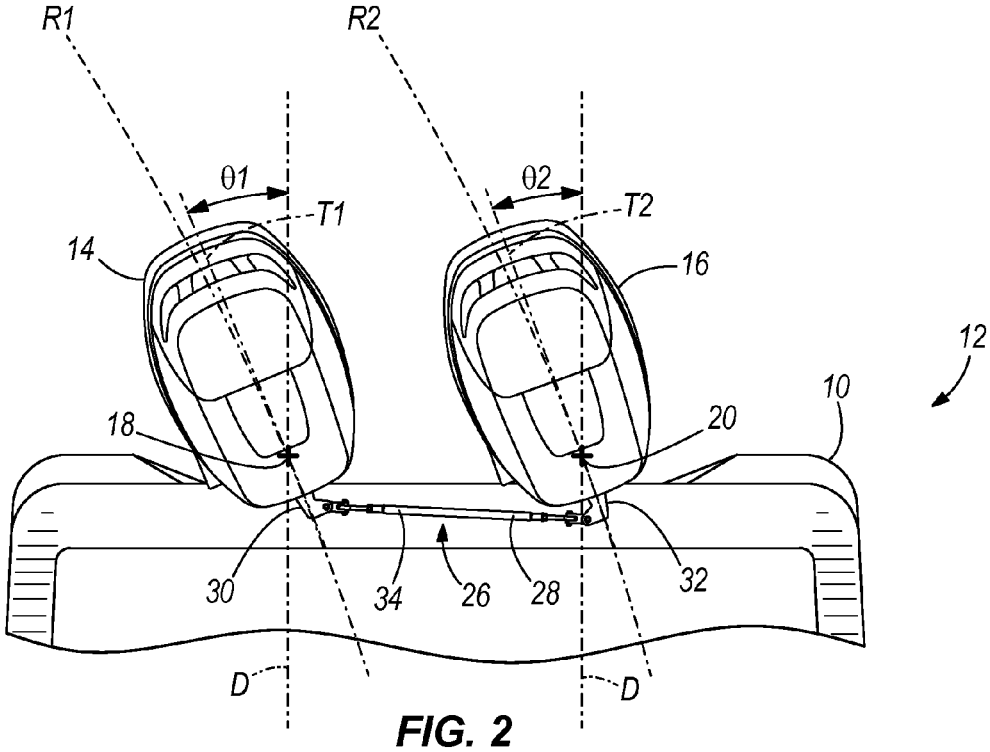
FIG. 2 is a top view of the marine vessel of FIG. 1, wherein the first and second marine drives are oriented in a first turning position.

FIG. 2 depicts the first and second marine drives 14, 16 in a first turning position, wherein the drives 14, 16 are oriented to achieve a starboard-wise turning movement of the vessel 12. In this orientation, each drive 14, 16 travels along a respective turning curvature R1, R2. Each drive 14, 16 is advantageously oriented to provide a respective propulsive thrust along a direction T1, T2 that is tangentially aligned with the respective curvature R1, R2, to thereby efficiently provide the thrust parallel to (i.e. along) the path of the respective curvature R1, R2. Since the curvatures R1, R2 have different radii, respectively, the drives 14, 16 are oriented at different angles θ1, θ2 with respect to the longitudinal direction D. That is, the angle θ1 does not equal the angle θ2 because the curvature R1 does not equal the curvature R2.

Figure 3:
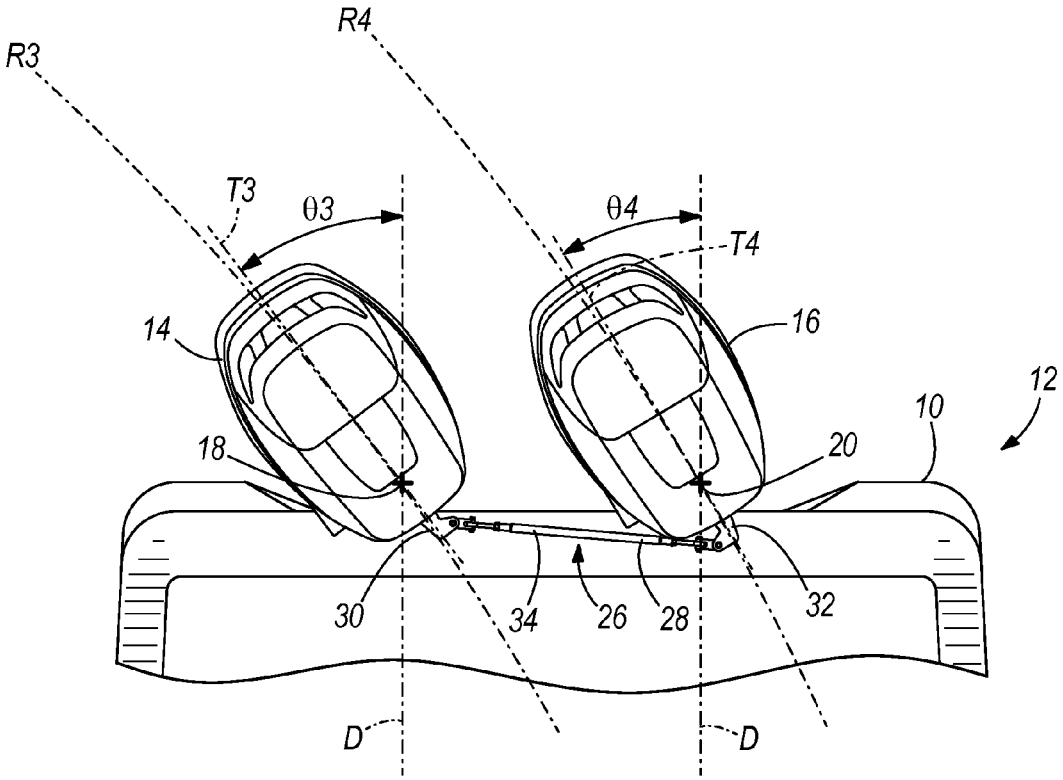
FIG. 3 is a top view of the marine vessel of FIG. 1, wherein the first and second marine drives are oriented in a second turning position.
Figure 4:
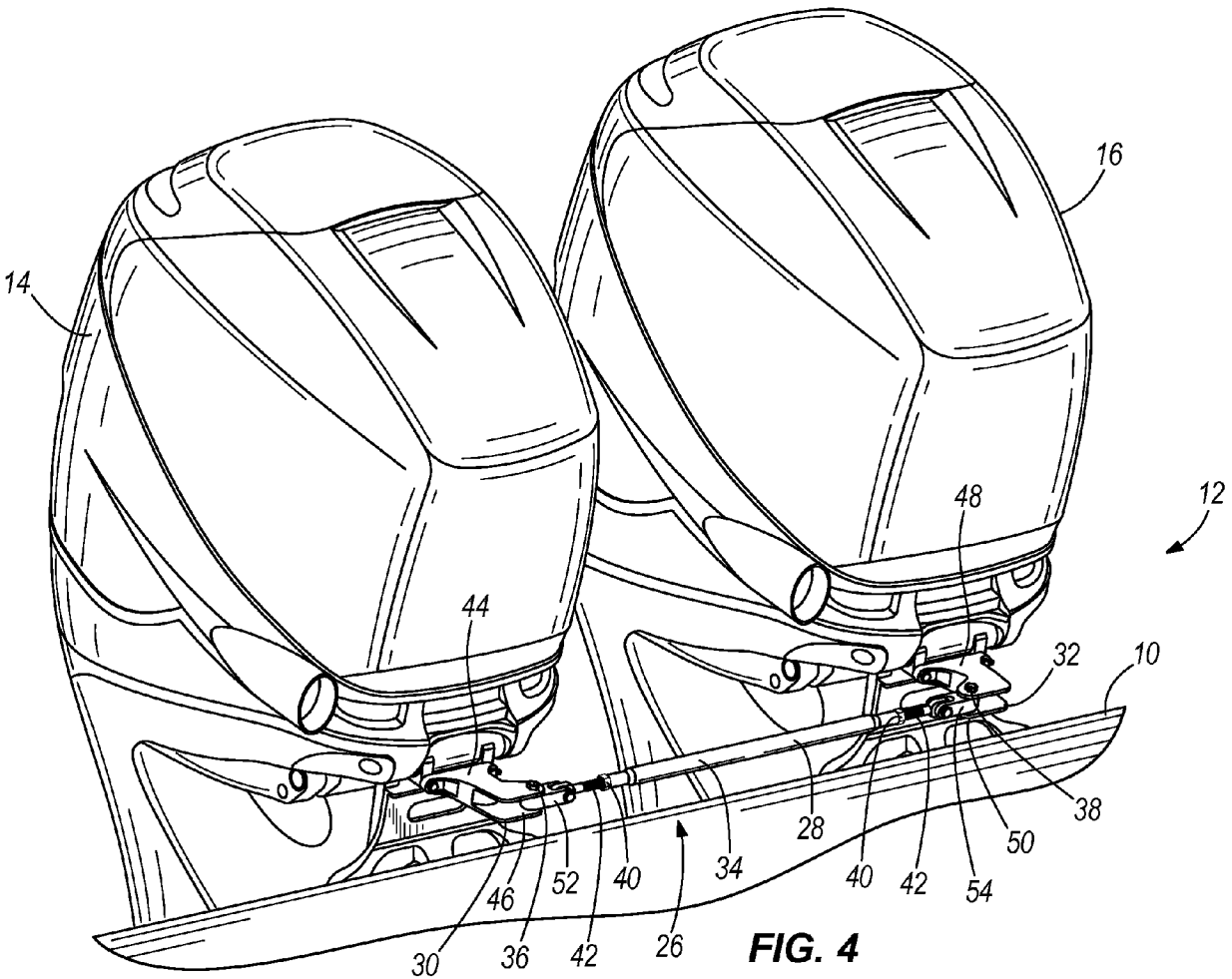
FIG. 4 is a perspective view of one example of a tie bar apparatus for connecting the first and second marine drives.

FIG. 3 depicts the first and second marine drives 14, 16 in a second, more severe turning position, wherein the drives 14, 16 are oriented to achieve a more severe starboard-wise turning movement of the vessel 12 than in FIG. 2, wherein each drive 14, 16 travels along a respective turning curvature R3, R4. Again, each drive is advantageously oriented to provide propulsive thrust in a direction T3, T4 that is tangentially aligned with the respective turning curvature R3, R4 to thereby efficiently provide the thrust, as described above regarding FIG. 2, parallel to (i.e. along) the path of the respective curvature R3, R4. Since the curvatures R3, R4 have different radii, respectively, the drives 14, 16 are oriented at different angles θ3, θ4 with respect to the longitudinal direction D. The angle θ3 does not equal the angle θ4 because the curvature R3 does not equal the curvature R4.

A tie bar apparatus 26 connects the first and second marine drives 14, 16 together so that the above-described different angles of the drives 14, 16 are achieved during starboard-wise and port-wise turning movements of the marine vessel 10. The tie bar apparatus 26 includes a linkage 28 that is geometrically configured to connect the first and second marine drives 14, 16 together so that during turning movements of the marine vessel 12, the first and second marine drives 14, 16 steer about the respective first and second steering axes 18, 20 at different angles, respectively. In the example shown in FIGS. 1-4, the tie bar apparatus 26 and linkage 28 include a first portion 30 that is pivotable about the first vertical steering axis 18 via its rigid connection to the first marine drive 14, a second portion 32 that is pivotable about the second vertical steering axis 20 via its rigid connection to the second marine drive 16, and a third portion 34 that extends between the first and second portions 30, 32. The first and third portions 30, 34 are pivotable about a first vertical pivot axis 36. The second and third portions 32, 34 are pivotable about a second vertical pivot axis 38.

The construction of the first portion 30, second portion 32 and third portion 34 can vary, as can the construction of the pivotable connections 36, 38 of the respective portions 30, 32, 34. In the example shown in FIG. 4, the first portion 30 and second portion 32 comprise generally L-shaped brackets. The third portion 34 comprises a coupler, similar to the coupler disclosed in FIG. 1 of incorporated U.S. Pat. No. 7,207,854. Among other things, the coupler includes threaded end nuts 40 and rod ends 42; however, other prior art structural combinations for the coupler can be employed, such as for example the arrangements described in the above-referenced incorporated U.S. patent documents.

The first portion 30 has a first end 44 and a second end 46. The first end 44 is rigidly connected to the first marine drive 14 at a location proximate the first steering axis 18 such that pivoting of the first marine drive 14 about the first steering axis 18 also causes pivoting of the first portion 30 about the first steering axis 18. The second end 46 is pivotably connected to the third portion 34 at the first vertical pivot axis 36. In this example, the pivotable connection 36 is provided by a bolt extending through the noted bracket and rod end 42; however, other types of pivotable connections can be employed. Similarly, the second portion 32 has a first end 48 and a second end 50. The first end 48 is rigidly connected to the second marine drive 16 for pivoting about the second steering axis 20 when the second marine drive 16 is pivoted. The second end 50 is pivotably connected to the third portion 34 at the second pivot axis 38, which can be constructed like the first pivot axis 36. In this example, the third portion 34 has first and second ends 52, 54. The first end 52 is pivotably connected to the second end 46 of the first portion 30. The second end 54 is pivotably connected to the second end 50 of the second portion 32. The noted pivotable connections 36, 38 are explained above.

As shown in FIG. 1, wherein the first and second marine drives 14, 16 are aligned in the longitudinal direction D, the first portion 30 and second portion 32 of the linkage 28 of tie bar apparatus 26 extend generally transversely (via the L-shape in this example) with respect to the third portion 34, which extends generally perpendicularly to the longitudinal direction D. The L-shaped first and second portions 30, 32 thus extend generally equally but oppositely with respect to the longitudinal direction D when the first and second marine drives 14, 16 are aligned in the longitudinal direction D. As stated above, in this example, the first and second portions 30, 32 are generally L-shaped and the third portion 34 is generally straight. Other configurations could be employed to accomplish the objectives set forth in the present disclosure. As shown in FIG. 1, the third portion 34 is shorter than the linear distance x that separates the first and second steering axes 18, 20. The first portion 30 pivots about the first pivot axis 36 with respect to the third portion 34. The second portion 32 pivots about the second pivot axis 38 with respect to the third portion 34. The first and second pivot axes 36, 38 are located inboard of the first and second steering axes 18, 20 on the marine vessel 12.

The linkage 28 described above and depicted in FIGS. 1-4 is geometrically configured so that during turning of the marine vessel 12, the first and second marine drives 14, 16 advantageously follow and remain tangentially aligned with (parallel to) concentric turning curvatures R1 and R2 (or R3 and R4), respectively, as described above with reference to FIGS. 2 and 3. In this particular example, the linkage 28 is configured such that the greater the degree of the turning movement of the marine vessel 12, the greater the difference between the respective steering angles θ1, θ2 (or θ3, θ4) of the first and second marine drives 14, 16. This is seen by comparison of FIG. 2 and FIG. 3. The lengths and orientations of the respective first, second and third portions 30, 32, 34 can thus be selected based upon the particular size and orientation of the marine drives 14, 16 so that the drives 14, 16 remain aligned with the turning curvatures R1 and R2 (or R3 and R4) to effectively utilize the thrust thereof along the direction of turning.

Figure 5:
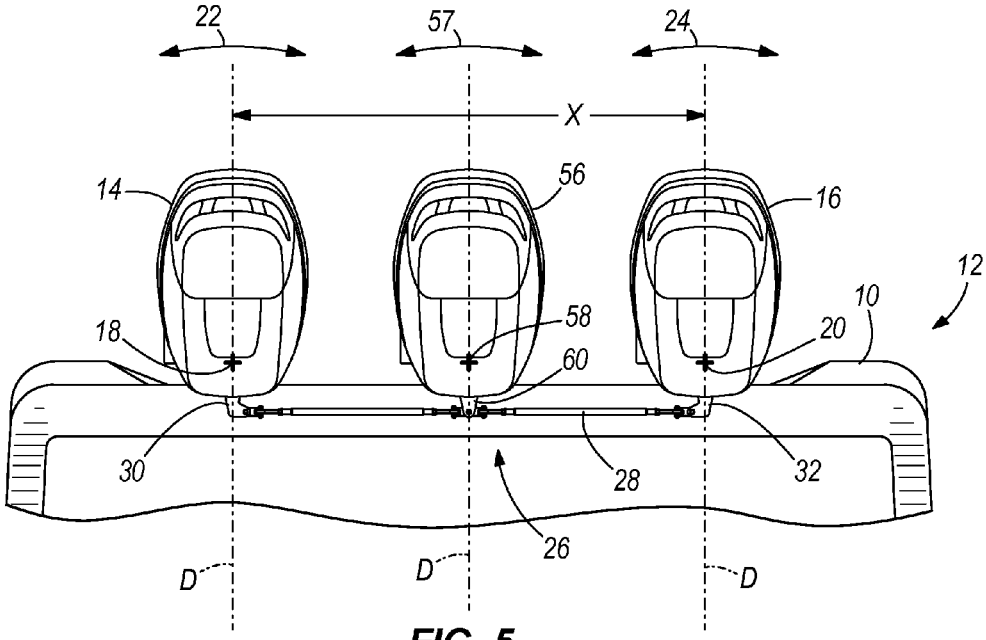
FIG. 5 is a top view of a marine vessel having first, second and third marine drives oriented in a forward position.
Figure 6:
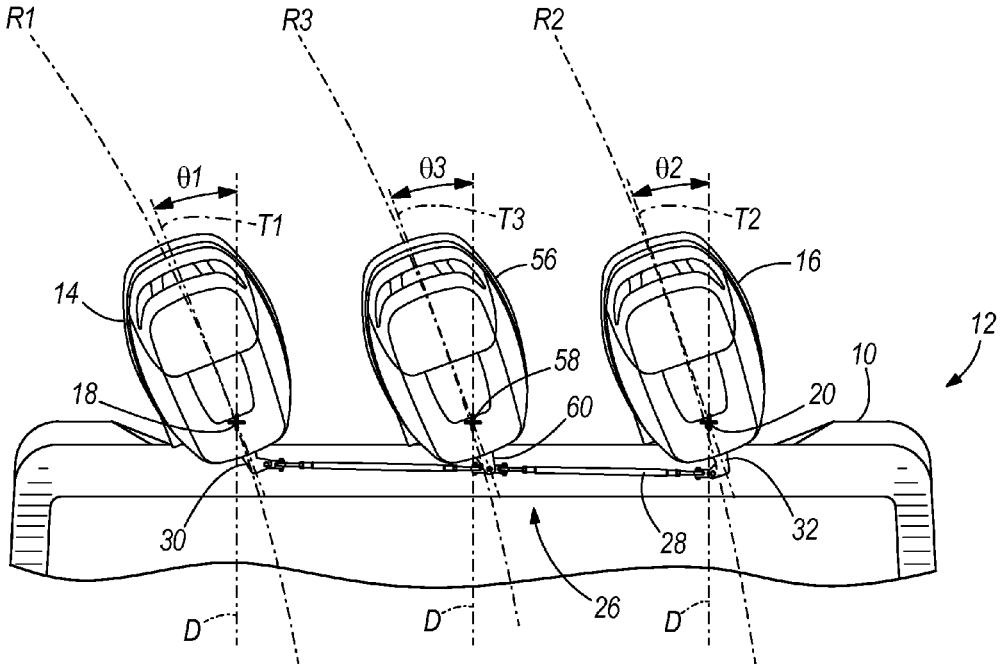
FIG. 6 is a top view of the marine vessel of FIG. 5, wherein the first, second and third marine drives are oriented in a first turning position.
Figure 7:
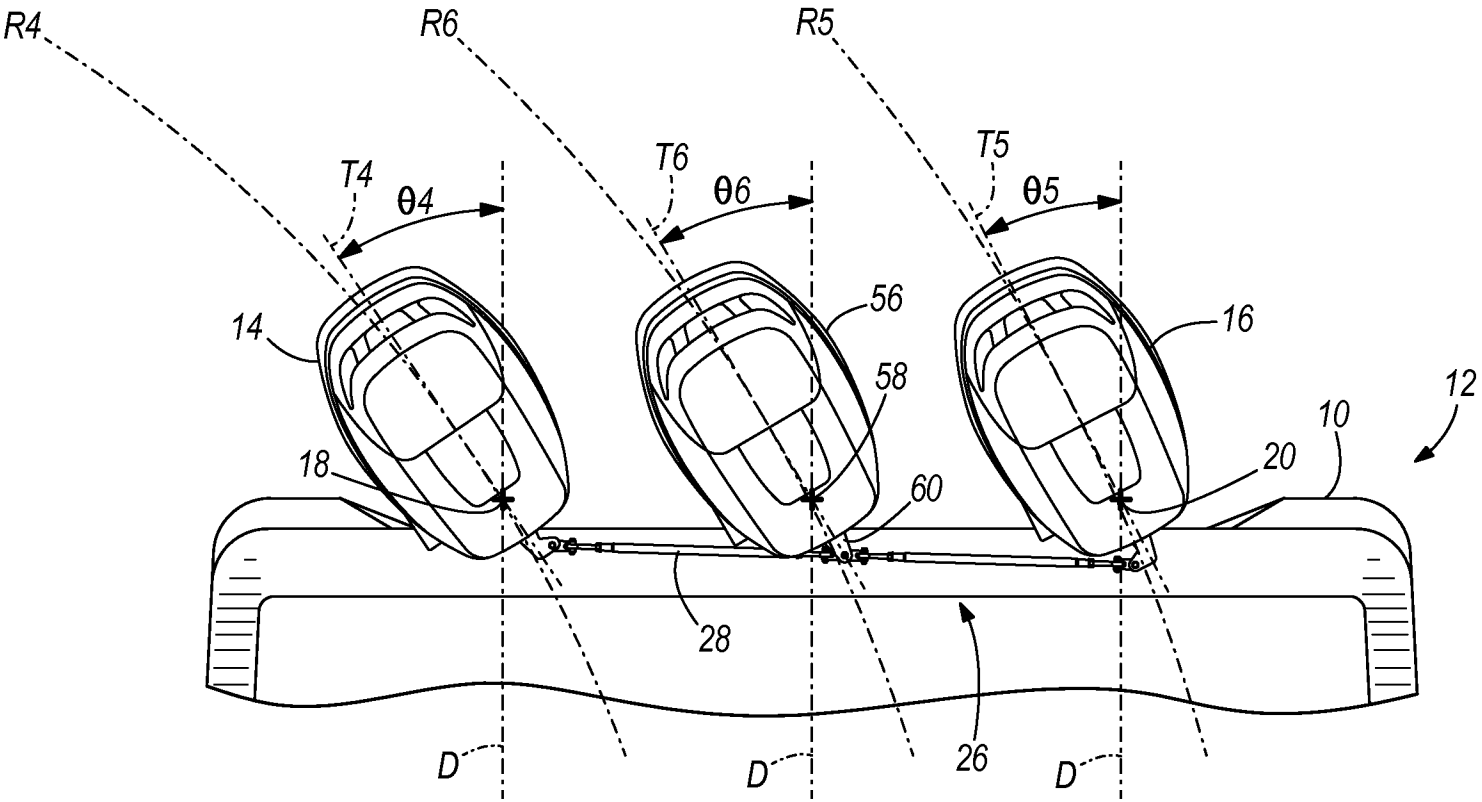
FIG. 7 is a top view of the marine vessel of FIG. 5, wherein the first, second and third marine drives are oriented in a second turning position.

FIGS. 5-7 depict another example of a tie bar apparatus 26. Several of the structures shown in FIGS. 5-7 are similar to the structures shown in FIGS. 1-4 and therefore like reference numbers are applied. In the examples of FIGS. 5-8, the marine vessel 12 has an additional, third marine drive 56 that is located between the first and second marine drives 14, 16. The third marine drive 56 is pivotable about an intermediate vertical steering axis 58 in both clockwise and counter-clockwise directions, as shown at arrows 57 in FIG. 5.

FIG. 5 depicts the first, second, and third marine drives 14, 16, 56 in a longitudinally aligned orientation with respect to the vessel 12 for achieving forward and/or rearward longitudinal translation of the vessel 12. FIG. 6 depicts the first, second, and third marine drives 14, 16, 56 in a first turning position, wherein the drives 14, 16, 56 are oriented to achieve a starboard-wise turning movement of the vessel 12. In this orientation, each drive 14, 16, 56 travels along a respective turning curvature R1, R2, R3. Similar to the example of FIGS. 1-4, each drive 14, 16, 56 is advantageously oriented to provide propulsive thrust along a direction T1, T2, T3 that is tangentially aligned with (parallel to) the respective curvature R1, R2, R3 to thereby efficiently apply the thrust in the direction of the respective curvature R1, R2, R3. Since the curvatures R1, R2, R3 have different radii, respectively, the drives 14, 16, 56 are oriented at different angles θ1, θ2, θ3 with respect to the longitudinal direction D. The angles θ1, θ2 and θ3 are not equal to each other because the curvatures R1, R2 and R3 are not equal to each other.

FIG. 7 depicts the first, second, and third marine drives 14, 16, 56 in a second, more severe turning position, wherein the drives 14, 16, 56 are oriented to achieve a more severe starboard-wise turning movement of the vessel 12, than in FIG. 6, wherein each drive 14, 16, 56 travels along a respective turning curvature R4, R5, R6. Each drive is advantageously oriented to provide propulsive thrust in a direction T4, T5, T6 that is tangentially aligned with (parallel to) the respective turning curvature R4, R5, R6. Since the curvatures R4, R5, R6 have different radii, respectively, the drives 14, 16, 56 are oriented at different angles θ4, θ5, θ6 with respect to the longitudinal direction D.

Figure 8:
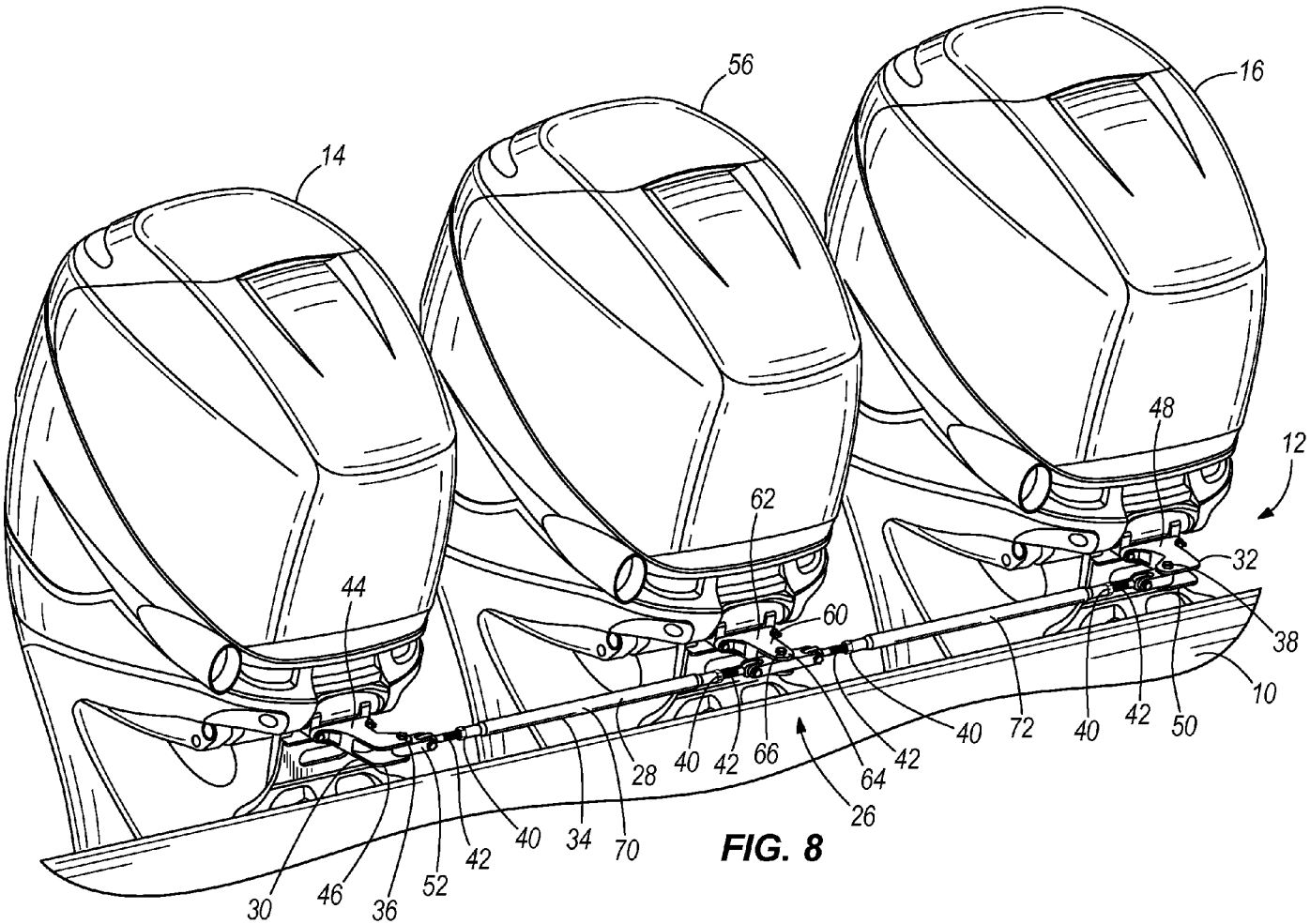
FIG. 8 is a perspective view of another example of a tie bar apparatus for connecting the first, second and third marine drives.

Connection of the third marine drive 56 to the stern 10 at the intermediate vertical steering axis 58 can be like the conventional connections of the first and second marine drives 14, 16 described herein above. According to this example, a fourth portion 60 is attached to the third marine drive 56 and pivotable about the intermediate steering axis 58. As shown in FIG. 8, the fourth portion 60 has a first end 62 and a second end 64. The first end 62 is attached to the third marine drive 56 so as to be pivotable about the intermediate steering axis 58. The second end 64 is pivotable with respect to the third portion 34 at a third pivot axis 66. In this example, the third portion 34 has a first section 70 extending between the first portion 30 and the fourth portion 60 and a second section 72 extending between the second portion 32 and the fourth portion 60.

Figure 9:
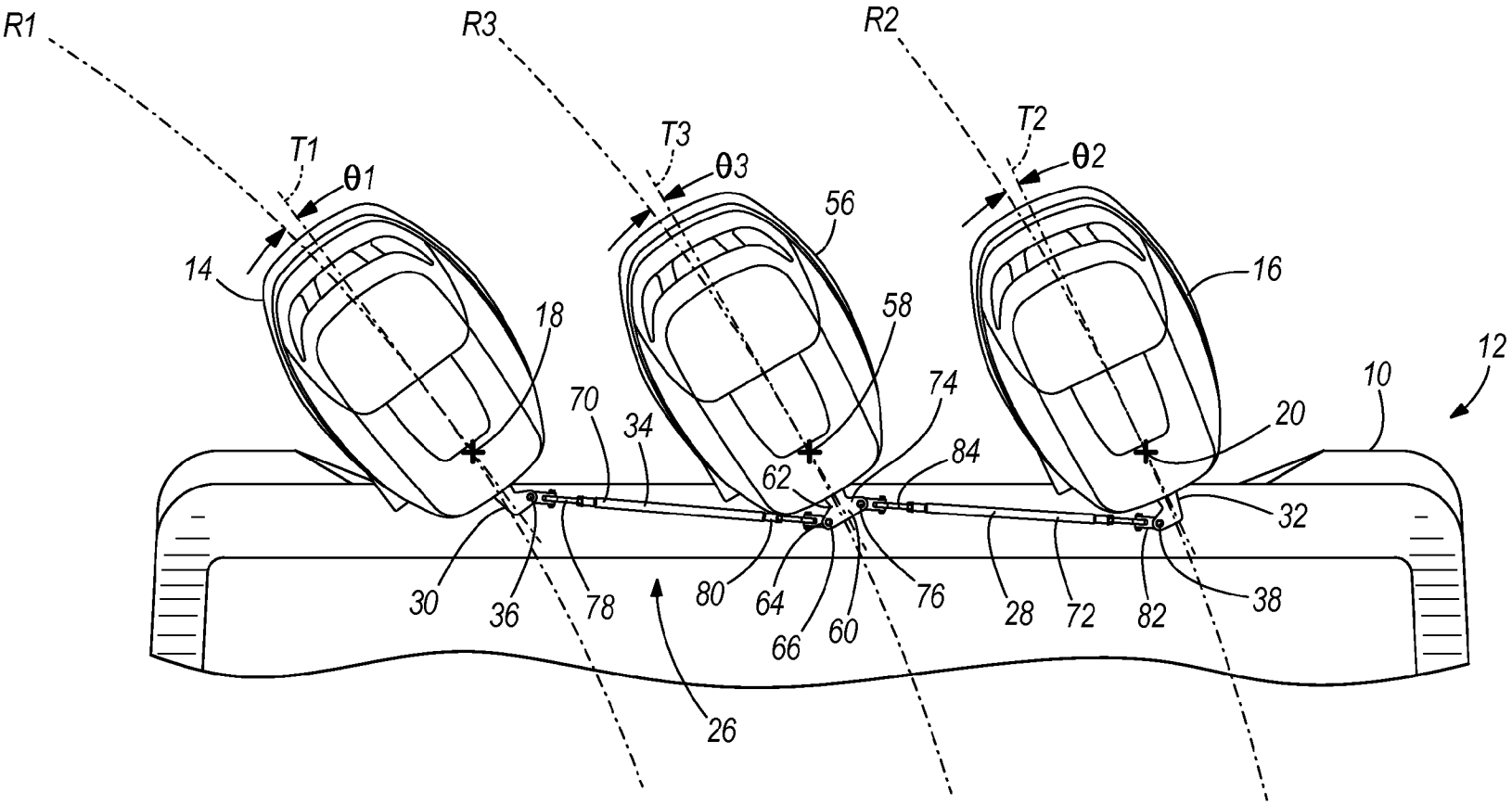
FIG. 9 is a top view of another example of a tie bar apparatus for connecting the first, second and third marine drives.

FIG. 9 depicts another example wherein the fourth portion 60 is generally T-shaped and has the noted first end 62, a second end 64 and a third end 74. The first end 62 is pivotable about the intermediate steering axis 58 via its connection to the third marine drive 56. The second end 64 is pivotable about the first section 70 of the third portion 34 at a third pivot axis 66. The third end 74 is pivotable about the second section 72 of the third portion 34 at a fourth pivot axis 76. In this example, the first section 70 of the third portion 34 has a first end 78 and a second end 80. The first end 78 is pivotable about the first pivot axis 36 and the second end 80 is pivotable about the third pivot axis 66. The second section 72 has a first end 82 and a second end 84. The first end 82 is pivotable about the second pivot axis 38 and the second end 84 is pivotable about the fourth pivot axis 76.

The present disclosure therefore provides examples of tie bar apparatuses for marine vessels that connect a plurality of marine drives together so that during turning movement of the marine vessel, the drives steer about respective vertical steering axes at different angles. The tie bar apparatus can be configured so as to provide means for accomplishing this function, which in turn provides increased efficiency of thrust over prior art arrangements. Further, examples described herein provide increased clearance between the marine drives during turning movements and thus allow the marine drives to be mounted closer together at a relatively smaller linear distance x between respective steering axes. This advantageously saves design space and improves efficiency of the overall system.

What is claimed is:

1. A tie bar apparatus for a marine vessel having at least first and second marine drives that extend aftwardly of the marine vessel and that are pivotable about respective first and second vertical steering axes, the tie bar apparatus comprising a linkage that is located forwardly of the first and second vertical steering axes with respect to the marine vessel and that connects the first and second marine drives together so that turning movements of the first and second marine drives about the respective first and second vertical steering axes are tied together; wherein the linkage has a first portion that is fixed to the first marine drive and pivots along with the first marine drive with respect to the first steering axis, a second portion that is fixed to the second marine drive and pivots along with the second marine drive with respect to the second steering axis, and a third portion that is located forwardly of the first and second vertical steering axes and extends between and connects the first and second portions together; the third portion having a first end that is pivotably connected to the first portion and a second end that is pivotably connected to the second portion; wherein the third portion is shorter than a linear distance between the first and second vertical steering axes; wherein during turning, movements of the marine vessel, the linkage causes output thrusts of the first and second marine drives to remain aligned with concentric first and second curved paths, respectively.

2. A tie bar apparatus according to claim 1, wherein the linkage is geometrically configured so that the greater the degree of said turning, movements of the marine vessel, the greater the difference between respective first and second steering angles of the first and second marine drives.

3. A tie bar apparatus according to claim 1, wherein the first portion and second portion extend generally transversely with respect to the third portion when the first and second marine drives provide output thrusts that are aligned in a longitudinal direction.

4. In a marine propulsion system having at least first and second marine drives that extend aftwardly of a stern of a marine vessel and that are rotatable about first and second vertical steering axes, respectively, for propelling and steering the marine vessel, a tie bar apparatus that is located forwardly of the first and second vertical steering axes and that connects the first and second marine drives together so that turning movements of the first and second marine drives are tied together, the tie bar apparatus comprising a first portion that is pivotable about the first vertical steering axis, a second portion that is pivotable about the second vertical steering axis, and a third portion that is located forwardly of the first and second vertical steering axes and extends between and connects the first and second portions together, wherein the first and third portions are pivotably connected together at a first vertical pivot axis, wherein the second and third portions are pivotably connected together at a second vertical pivot axis, and wherein the first and second vertical pivot axes are located inboard and forwardly of the first and second vertical steering axes with respect to the marine vessel; and wherein during turning movements of the marine vessel, the linkage causes output thrusts of the first and second marine drives to remain aligned with concentric first and second curved paths, respectively.

5. A tie bar apparatus according to claim 4, wherein the first portion has a first end and a second end, the first end being connected to the first marine drive for pivoting about the first vertical steering as and the second end being pivotably connected to the third portion at the first vertical pivot axis.

6. A tie bar apparatus according to claim 5, wherein the second portion has a first end and a second end, the first end being connected to the second marine drive for pivoting about the second vertical steering axis and the second end being pivotably connected to the third portion at the second vertical pivot axis.

7. A tie bar apparatus according to claim 6, wherein the third portion has first and second ends, the first end being pivotably connected to the second end of the first portion and the second end being pivotably connected to the second end of the second portion.

8. A tie bar apparatus according to claim 4, wherein the first portion and second portion extend transversely with respect to the third portion when the first and second marine drives provide output thrusts that are aligned in a longitudinal direction.

9. A tie bar apparatus according to claim 8, wherein the third portion extends perpendicularly with respect to the longitudinal direction when the first and second marine drives provide output thrusts that are aligned in the longitudinal direction.

10. A tie bar apparatus according to claim 8, wherein the first and second portions are generally L-shaped and wherein the third portion is generally straight.

11. A tie bar apparatus according to claim 5, wherein the first and second steering axes are separated by a linear distance and wherein the third portion is shorter than the linear distance.

12. A tie bar apparatus according to claim 5, comprising a fourth portion that is pivotable about an intermediate vertical steering axis for a third marine drive that is located between the first and second marine drives, wherein the third portion is pivotably connected to the fourth portion.

13. A tie bar apparatus according to claim 12, wherein the fourth portion has a first end and a second end, the first end being pivotable about the intermediate vertical steering axis and the second end being pivotably connected to the third portion at a third vertical pivot axis.

14. A tie bar apparatus according to claim 12, wherein the third portion comprises a first section extending between the first portion and the fourth portion and a second section extending between the second portion and the fourth portion.

15. A tie bar apparatus according to claim 12, wherein the fourth portion has a first end, a second end, and a third end, the first end being pivotable about the intermediate vertical steering axis, the second end being pivotably connected to the third portion at a third vertical pivot axis, and the third end being pivotably connected to the third portion at a fourth vertical pivot axis.

16. A tie bar apparatus according to claim 15, wherein the third portion comprises a first section extending between the first portion and the fourth portion and a second section extending between the second portion and the fourth portion; and wherein the first section has a first end and a second end, the first end being pivotable about the first vertical pivot axis and the second end being pivotably connected to the third portion at the third vertical pivot axis; wherein the second section has a first end and a second end, the first end being pivotable about the second vertical pivot axis and the second end being pivotably connected to the third portion at the fourth vertical pivot axis.

17. A marine vessel having a bow and a stern, the marine vessel comprising:

first and second marine drives that extend aftwardly of the stern of the marine vessel and that are pivotable about respective first and second steering axes; and a tie bar linkage that is located forwardly of the first and second steering axes, the tie bar linkage connecting the first and second marine, drives together so that turning movements of the first and second marine drives are tied together;

wherein the tie bar linkage comprises a first portion that is fixed to the first marine drive and pivots with the first marine drive with respect to the first steering axis, a second portion that is fixed to the second marine drive, and pivots with the second marine drive with respect to the second steering axis, and a third portion that is located forwardly of the first and second steering axes and that extends between and connects first and second portions together, the third portion having a first end that is pivotably connected to the first portion and a second end that is pivotably connected to the second portion; wherein the third portion is shorter than a linear distance between the first and second steering axes; and wherein during turning movements of the marine vessel, the linkage causes output thrusts of the first and second marine drives to remain aligned with concentric first and second curved paths, respectively.

* * * * *

UNITED STATES PATENT AND TRADEMARK OFFICE

CERTIFICATE OF CORRECTION

PATENT NO. : 8,512,085 B1
APPLICATION NO. : 13/224058
DATED : August 20, 2013
INVENTOR(S) : David A. Kobilic It is certified that error appears in the above-identified patent and that said Letters Patent is hereby corrected as shown below:

In the Claims:

Column 6, lines 19-43, Claim 1, should read:

--1. A tie bar apparatus for a marine vessel having at least first and second marine drives that extend aftwardly of the marine vessel and that are pivotable about respective first and second vertical steering axes, the tie bar apparatus comprising a linkage that is located forwardly of the first and second vertical steering axes with respect to the marine vessel and that connects the first and second marine drives together so that turning movements of the first and second marine drives about the respective first and second vertical steering axes are tied together; wherein the linkage has a first portion that is fixed to the first marine drive and pivots along with the first marine drive with respect to the first steering axis, a second portion that is fixed to the second marine drive and pivots along with the second marine drive with respect to the second steering axis, and a third portion that is located forwardly of the first and second vertical steering axes and extends between and connects the first and second portions together; the third portion having a first end that is pivotably connected to the first portion and a second end that is pivotably connected to the second portion; wherein the third portion is shorter than a linear distance between the first and second vertical steering axes; wherein during turning movements of the marine vessel, the linkage causes output thrusts of the first and second marine drives to remain aligned with concentric first and second curved paths, respectively.--

Column 6, lines 44-48, Claim 2, should read:

--2. A tie bar apparatus according to claim 1, wherein the linkage is geometrically configured so that the greater the degree of said turning movements of the marine vessel, the greater the difference between respective first and second steering angles of the first and second marine drives.--

Column 8, lines 25-52, Claim 17, should read:

--17. A marine vessel having a bow and a stern, the marine vessel comprising: first and second marine Signed and Sealed this
First Day of October, 2013

Teresa Stanek Rea
*Deputy Director of the United States Patent and Trademark Office* drives that extend aftwardly of the stern of the marine vessel and that are pivotable about respective first and second steering axes; and a tie bar linkage that is located forwardly of the first and second steering axes, the tie bar linkage connecting the first and second marine drives together so that turning movements of the first and second marine drives are tied together: wherein the tie bar comprises a first portion that is fixed to the first marine drive and pivots with the first marine drive with respect to the first steering axis, a second portion that is fixed to the second marine drive, and pivots with the second marine drive with respect to the second steering axis, and a third portion that is located forwardly of the first and second steering axes and that extends between and connects first and second portions together, the third portion having a first end that is pivotably connected to the first portion and a second end that is pivotably connected to the second portion; wherein the third portion is shorter than a linear distance between the first and second steering axes; and wherein during turning movements of the marine vessel, the linkage causes output thrusts of the first and second marine drives to remain aligned with concentric first and second curved paths, respectively.--